US005474845A

United States Patent [19]

Turunen et al.

[11] Patent Number: 5,474,845

[45] Date of Patent: Dec. 12, 1995

[54] MELT-SPUN HIGH-STRENGTH POLYETHYLENE FIBRE

[75] Inventors: Olli T. Turunen; Jan Fors, both of Porvoo, Finland; Erik Thaels, Westerlo, Belgium

[73] Assignee: Borealis A/S, Lyngby, Denmark

[21] Appl. No.: 343,483

[22] PCT Filed: May 28, 1993

[86] PCT No.: PCT/FI93/00230

§ 371 Date: Dec. 16, 1994

§ 102(e) Date: Dec. 16, 1994

[87] PCT Pub. No.: WO93/24686

PCT Pub. Date: Dec. 9, 1993

[30] Foreign Application Priority Data

May 29, 1992 [FI] Finland ..... 922464

[51] Int. Cl.[6] ..... D02G 3/00

[52] U.S. Cl. ..... 428/364; 428/394; 526/348.1; 526/352

[58] Field of Search ..... 428/364, 394; 210/210.8, 176.1; 526/348.1, 352

[56] References Cited

U.S. PATENT DOCUMENTS

| | | | |
|---|---|---|---|
| 4,228,118 | 10/1980 | Wu et al. | 264/210.8 |
| 4,415,522 | 11/1983 | Capaccio et al. | 264/210.8 |
| 4,422,993 | 12/1983 | Smith et al. | 264/210.8 |
| 4,436,689 | 3/1984 | Smith et al. | 264/204 |
| 4,663,101 | 5/1987 | Kavesh et al. | 264/210.8 |
| 5,252,394 | 10/1993 | Kouno et al. | 428/364 |
| 5,302,453 | 4/1994 | Kouno et al. | 428/364 |
| 5,342,567 | 8/1994 | Chen et al. | 264/210.8 |

FOREIGN PATENT DOCUMENTS

| | | |
|---|---|---|
| 0344860 | 12/1989 | European Pat. Off. . |
| 1498628 | 1/1978 | United Kingdom . |
| 1506565 | 4/1978 | United Kingdom . |
| 1568964 | 6/1980 | United Kingdom . |
| 92/11125 | 7/1992 | WIPO . |

OTHER PUBLICATIONS

Journal of Applied Polymer Science, vol. 22, 2553–2571 (1978), Title: Multistage Stretching of H–D Polyethylene Mono filaments in melt spinning.

*Primary Examiner*—N. Edwards
*Attorney, Agent, or Firm*—Dilworth & Barrese

[57] ABSTRACT

The invention concerns a high strength polyethylene fibre, which is prepared by melt spinning polyethylene having a high density through a spinnerette, by cooling the fibre coming out from the spinnerette and by stretching the fibre obtained at 50°–150° C. The polyethylene used in the melt spinning is a homopolymer of ethylene having a weight average molecular weight $M_w$ between 125000–175000 g/mol, a number average molecular weight $M_n$ between 26000–33000 g/mol, polydispersity ($M_w/M_n$) below 5 and the density higher than 955 g/dm$^3$. The stretching degree in the drawing step is at least 400%.

15 Claims, No Drawings

MELT-SPUN HIGH-STRENGTH POLYETHYLENE FIBRE

BACKGROUND OF THE INVENTION

The invention concerns melt-spun polyethylene fibres having a high strength.

A conventional method for manufacturing fibres from synthetic polymers is spinning with spinnerettes, where a polymer brought in flowing state is pressed through holes and the fibres being formed are stretched, whereby the fibres become thinner and an orientation of molecular chains takes place in the longitudinal direction of the fibres. Depending on how the polymer used in the manufacturing of the fibres is brought into a flowing state, fibres are referred to, for example, as solution-spun, gel-spun and melt-spun fibres.

Mixtures of a polymer and a solvent are used as raw material for fibres both in solution spinning and gel spinning, which in view of the industrial production of the fibres is a drawback resulting in increased costs. Firstly, in the fibre production it is necessary to use extra chemicals (solvents, swelling agents), the adding and recovery of which from the fibres cause additional costs. Secondly, the presence of extra chemicals in the fibre manufacturing process decreases the production capacity. Although at present fibres can be produced by gel-spinning polyethylene fibres having a strength comparable to that of carbon fibres or even greater, the high manufacturing costs of this kind of fibres prevent wider usage of the fibres in industrial applications.

Compared to the former methods the melt spinning is simpler, because the polymer is simply melted in an extruder and pressed through holes. The extra costs and drawbacks related to the use of additional chemicals can thereby be avoided. By melt spinning it is also possible to produce polyethylene fibres at sufficently high production rate.

Recently a lot of research work has been carried out for developing processes for the production of high strength polyethylene fibres to replace higher priced carbon fibres and LCP-fibres. Very many factors have influence on the quality of the fibres obtained and on the strength properties. Such factors are, among others, the properties of the polyethylene used as raw material, the spinning conditions such as the temperature, the dimensions and contours of the spinning holes and especially the conditions used in the stretching. Among the properties of the fibre raw material, the molecular weight has appeared to be especially important.

Concerning the prior art, reference is also made, among others to GB-patent publications 1498628 and 1568964. In the method according to the first mentioned patent polyethylene having a weight average molecular weight of between 50000–200000 is extruded into fibres, which are cooled to a temperature of 100°–120° C. at a rate of 1°–15° C. per minute and the fibres are cooled rapidly thereafter. After that the fibres are stretched at a temperature, which is at least 40° C. below the melting point by using a draw ratio of at least 18. This process enables however a very slow spinning due to the slow cooling step. The spinning rates disclosed in the patent are thereby only 4–5 m/min. Also the fibre strength obtained by the method is not very high. In the latter GB-patent there is used polyethylene having a weight average molecular weight of greater than 150000 and the ratio of weight average molecular weight to the number average molecular weight is greater than 5.

Concerning the prior art, reference is also made to U.S. Pat. No. 4,228,118, in which polyethylene having a number average molecular weight of at least 20000 and a weight average molecular weight below 125000 is extruded at a temperature of 220°–335° C. The molten fibres are cooled and the fibres obtained are stretched at a rate, which is at least 30 m/min. After that the fibres are hot-stretched at a draw ratio of at least 20:1 at a temperature of 115°–132° C. It is aimed by this method to obtain fibres having a strength of at least 12 g/den (10,6 cN/dtex).

The information concerning the factors affecting fibre strength and interactions between them is very confusing and incomplete. Only some of the affecting factors are generally known. For example it is known that by increasing the molecular weight of the fibre raw material, fibres having a higher strength are basically obtained. Likewise it is known that stronger fibres can be achieved by stretching. Fibre strength has also been tried to be improved by using different stretching conditions.

When the aim has been fibres having a strength higher than that of the fibres obtained according to the prior art, the known solutions have not given results. The molecular weight of the fibres cannot be increased freely, because thereby the melt spinning of the fibres becomes impossible. The stretching of the fibres has also limits, which cannot be exceeded without impairing some or all properties of the fibres.

SUMMARY OF THE INVENTION

According to the invention it has been found that in order to achieve very high fibre strengths, the properties of the fibre raw material have to be within certain limits, whereby by using normal stretching, fibres having a strength clearly exceeding the strength of the fibres according to the prior art are obtained. Those properties of the fibre raw material, which must be chosen with certain way, are the weight average molecular weight, number average molecular weight and especially the ratio of them, in other words the polydispersity of the polyethylene used as the fibre raw material reflecting the molecular weight distribution, and the density of the fibre.

Thus the invention concerns a high strength polyethylene fibre, which is prepared by melt spinning polyethylene having a high density through a spinnerette, by cooling the fibres coming out from the holes and by stretching the fibre obtained at a temperature of 50°–150 ° C. The fibre according to the invention is characterized in that the polyethylene used in the melt spinning is a homopolymer of ethylene, which fulfills the following conditions:

the weight average molecular weight $M_w$ is between 125000–175000 g/mol;

the number average molecular weight $M_n$ is between 26000–33000 g/mol;

polydispersity ($M_w/M_n$) is below 5;

the density is higher than 955 g/dm$^3$;

and that the stretching degree in the drawing step is at least 400%.

DESCRIPTION OF THE PREFERRED EMBODIMENTS

The polyethylene fibre according to the invention is thus prepared by melt spinning an ethylene homopolymer having a weight average molecular weight $M_W$ of higher than 125000 g/mol. By using polyethylene having a lower molecular weight the fibre strengths obtainable are lower than optimal independent of other conditions. On the other hand, increasing the molecular weight above the value of 175000 g/mol makes the fibre spinning difficult and does not lead to the results according to the invention.

Also the number average molecular weight of the polyethylene used has to be within certain very narrow limits in order to achieve the results according to the invention. Thus $M_n$ is according to the invention between 26000–33000 g/mol. The weight and number average molecular weights cannot however be chosen freely within the ranges specified, but the ratio of them has to be according to the invention within a certain range. Thus the polydispersity ($M_w/M_n$) has to be not greater than 5, but preferably between 2–5.

The third important parameter in the polyethylene used as the raw material for the polyethylene fibre according to the invention is the density. It has been found, that if the density is lower than 955 g/dm$^3$, high strengths cannot be achieved, although the other properties have been selected within the limits given. Thus the density of the polyethylene has to be at least 955 g/dm$^3$, but preferably at least 958 g/dm$^3$.

Further the polyethylene fibre according to the invention has to be further stretched at least 400% in order to obtain the desired strengths. The stretching is carried out preferably in two or more steps. The final stretching has to be between 400–2500%, preferably between 700–2500%. The stretching can be carried out for example by conveying the fibres around one or more pairs of rolls. By controlling the speeds of the rolls the desired drawing degree is achieved. In the drawing it is preferable to use rolls having a surface temperature of between 50°–150° C. in order to maintain as even drawing temperature as possible.

The invention is explained with the following examples enclosed.

Various polyethylene grades were spun into fibres in an extruder, where the screw diameter was 30 mm and the length/diameter ratio was 20: 1. The capacity of the extruder was 6 kg/h. The molten polyethylene emerging from the extruder was conveyed by a feed pump to a spinnerette having 37 holes of 1 mm by diameter. The length/diameter ratio of the holes was 4.

The fibres emerging from the spinnerette were lead through a cooling stack having a length of 1.5 m. From the cooling stack the fibre bundle was conveyed round a reverse roll to the stretching rolls. The stretching rolls comprised three heatable pairs of rolls having a controllable speed. The first stretching was carried out with the aid of the roll pairs. The second stretching was carried out by using the same rolls.

For the stretched fibres, the drawing degree was measured as percentages, titre as desilex (1 dtex=the weight in grams of a fibre having a length of 10000 m), elongation as percentages and tenacity (cN/dtex) according to standard DIN 53861, the drawing gap being 10 mm and drawing speed being 40 mm/min.

EXAMPLE 1

An ethylene homopolymer was prepared by polymerizing ethylene in a pilot-scale gas phase reactor and by using a Ziegler-Natta catalyst prepared according to U.S. Pat. No. 4,482,687. Triethylaluminum (TEA) was used as a cocatalyst. The polymerization conditions were as follows:

| | |
|---|---|
| Reaction temperature (°C.) | 108 |
| Hydrogen/ethylene ratio | 0.20 |
| Ethylene partial pressure (bar) | 9.5 |
| Production rate (kg/h) | 7–8 |
| The properties of the polyethylene were as follows: | |
| Weight average molecular weight ($M_w$) = | 120000 g/mol |
| Number average molecular weight ($M_n$) = | 26100 g/mol |
| Polydispersity D ($M_w/M_n$) = | 4.6 |
| Melt viscosity $MI_2$ = | 1.5 |
| Density = | 961 g/dm$^3$ |

Fibres were spun and stretched in the apparatus described above by using a spinning temperature of 190° C. The stretching conditions and the fibre properties are presented in the following Table 1.

TABLE 1

| | Stretching conditions | | | | | | | | | |
|---|---|---|---|---|---|---|---|---|---|---|
| | 1. rolls | | 2. rolls | | 3. rolls | | | | | Elon- |
| Drawing step | speed m/s | temperature °C. | speed m/s | temperature °C. | speed m/s | temperature °C. | Stretching % | Titre dtex | Tenacity cN/dtex | gation % |
| 1. drawing | 20 | 65 | 100 | 100 | 200 | 130 | 900 | 8.2 | 10.0 | 22 |
| 2. drawing | 20 | 50 | 38 | 110 | 45 | 100 | 2150 | 3.8 | 14.4 | 12 |

Already after one stretching a similar strength value as disclosed in U.S. Pat. No. 4,228,118 was achieved, although optimal results are not obtained even with two stretchings.

EXAMPLE 2

Fibres were spun and stretched from the polyethylene according to example 1 by using a spinning temperature of 190° C. The stretching conditions and the results are presented in the following Table 2.

TABLE 2

| Drawing step | Stretching conditions 1. rolls speed m/s | 1. rolls temperature °C. | 2. rolls speed m/s | 2. rolls temperature °C. | 3. rolls speed m/s | 3. rolls temperature °C. | Stretching % | Titre dtex | Tenacity cN/dtex | Elongation % |
|---|---|---|---|---|---|---|---|---|---|---|
| 1. drawing | 20 | 90 | 120 | 110 | 240 | 130 | 1100 | 7.5 | 10.3 | 23 |
| 2. drawing | 20 | 50 | 35 | 110 | 40 | 100 | 2300 | 3.5 | 15.8 | 14 |

EXAMPLE 3

An ethylene homopolymer was prepared by polymerizing ethylene in a pilot-scale gas phase reactor and by using a Ziegler-Natta catalyst prepared according to U.S. Pat. No. 4,482,687. Triethylaluminum (TEA) was used as a cocatalyst. The polymerization conditions were as follows:

| | |
|---|---|
| Reaction temperature (°C.) | 108 |
| Hydrogen/ethylene ratio | 0.20 |
| Ethylene partial pressure (bar) | 20.0 |
| Production rate (kg/h) | 7–8 |
| The properties of the polyethylene were as follows: | |
| Weight average molecular weight ($M_w$) = | 158500 g/mol |
| Number average molecular weight ($M_n$) = | 32700 g/mol |
| Polydispersity D ($M_w/M_n$) = | 4.8 |
| Melt viscosity $MI_2$ = | 0.5 |
| Density = | 961.4 g/dm$^3$ |

Fibres were spun and stretched in the apparatus described above by using a spinning temperature of 190° C. The stretching conditions and the fibre properties are presented in the following Table 3.

TABLE 3

| Drawing step | Stretching conditions 1. rolls speed m/s | 1. rolls temperature °C. | 2. rolls speed m/s | 2. rolls temperature °C. | 3. rolls speed m/s | 3. rolls temperature °C. | Stretching % | Titre dtex | Tenacity cN/dtex | Elongation % |
|---|---|---|---|---|---|---|---|---|---|---|
| 1. drawing | 20 | 50 | 80 | 110 | 159 | 130 | 700 | 8.6 | 16.5 | 33 |
| 2. drawing | 20 | 50 | 32 | 110 | 37 | 100 | 1400 | 4.2 | 18.7 | 16 |

EXAMPLE 4

From the polyethylene according to example 1, fibres were spun and stretched in the apparatus described above by using a spinning temperature of 285° C. The stretching conditions and the fibre properties are presented in the following Table 4.

TABLE 4

| Drawing step | Stretching conditions 1. rolls speed m/s | 1. rolls temperature °C. | 2. rolls speed m/s | 2. rolls temperature °C. | 3. rolls speed m/s | 3. rolls temperature °C. | Stretching % | Titre dtex | Tenacity cN/dtex | Elongation % |
|---|---|---|---|---|---|---|---|---|---|---|
| 1. drawing | 20 | 50 | 90 | 110 | 180 | 130 | 800 | 7.2 | 8.6 | 25 |
| 2. drawing | 20 | 50 | 38 | 110 | 45 | 100 | 1900 | 3.3 | 13.8 | 16 |

EXAMPLE 5 (COMPARISON)

Polyethylene fibre was spun and stretched according to example 1 from a commercial ethylene homopolymer (NCPE 1901, manufactured by Neste Oy). The properties of the polymer were as follows:

| | |
|---|---|
| Weight average molecular weight ($M_w$) = | 170500 g/mol |
| Number average molecular weight ($M_n$) = | 25300 g/mol |
| Polydispersity D ($M_w/M_n$) = | 6.7 |
| Melt viscosity $MI_2$ = | 0.7 |
| Density = | 952 g/dm$^3$ |

Fibres from the polyethylene were spun and stretched according to example 1 at a spinning temperature of 190° C. The conditions and the results are presented in the following Table 5.

TABLE 5

| Drawing step | Stretching conditions 1. rolls speed m/s | 1. rolls temperature °C. | 2. rolls speed m/s | 2. rolls temperature °C. | 3. rolls speed m/s | 3. rolls temperature °C. | Stretching % | Titre dtex | Tenacity cN/dtex | Elongation % |
|---|---|---|---|---|---|---|---|---|---|---|
| 1. drawing | 30 | | 100 | | 106 | | 250 | 31 | 4.3 | 194 |
| 2. drawing | 30 | 50 | 61 | 110 | 82 | | 850 | 12.6 | 10.6 | 16 |

The results show that by using polyethylene having a D-value greater than 5 and a density below 955 g/dm$^3$, much lower strength values than the corresponding values of the fibres according to the invention are obtained.

EXAMPLE 6 (COMPARISON)

According to example 1 polyethylene fibre was spun and stretched from a commercial LLDPE polymer (NCPE 8020, manufactured by Neste Oy). The properties of the polymer were as follows:

| | |
|---|---|
| Weight average molecular weight ($M_w$) = | 120000 g/mol |
| Number average molecular weight ($M_n$) = | 30000 g/mol |
| Polydispersity D ($M_w/M_n$) = | 4 |
| Melt viscosity $MI_2$ = | 0.9 |
| Density = | 919 g/dm$^3$ |

Fibres from the polyethylene were spun and stretched according to example 1 at a spinning temperature of 190° C. The conditions and the results are presented in the following Table 6.

Ethylene was homopolymerized in a pilot-scale gas phase reactor by using a Ziegler-Natta catalyst prepared as disclosed in Finnish patent application no. 901895. Triethylaluminum (TEA) was used as a cocatalyst. The polymerization conditions were as follows:

| | |
|---|---|
| Reaction temperature (°C.) | 109 |
| Hydrogen/ethylene ratio | 0.11 |
| Ethylene partial pressure (bar) | 11.0 |
| Production rate (kg/h) | 7–9 |
| The properties of the polyethylene were as follows: | |
| Weight average molecular weight ($M_w$) = | 139000 g/mol |
| Number average molecular weight ($M_n$) = | 31500 g/mol |
| Polydispersity D ($M_w/M_n$) = | 4.4 |
| Melt viscosity $MI_2$ = | 0.5 |
| Density = | 959 g/dm$^3$ |

Fibres from the polyethylene were spun and stretched in the apparatus described above by using a spinning temperature of 190° C. The fibres were stretched in this example only once. The stretching conditions and the fibre properties are presented in the following Table 7.

TABLE 6

| Drawing step | Stretching conditions 1. rolls speed m/s | 1. rolls temperature °C. | 2. rolls speed m/s | 2. rolls temperature °C. | 3. rolls speed m/s | 3. rolls temperature °C. | Stretching % | Titre dtex | Tenacity cN/dtex | Elongation % |
|---|---|---|---|---|---|---|---|---|---|---|
| 1. drawing | 20 | 50 | 69 | 80 | 91 | 80 | 350 | 24.5 | 3.6 | 32 |
| 2. drawing | 20 | 50 | 25 | 80 | 29 | 80 | 550 | 22.8 | 4.0 | 31 |

The results show that when using an ethylene polymer having a very low density, the strength properties of the fibres obtained are much lower than those of the fibres according to the invention.

EXAMPLE 7

An ethylene homopolymer was prepared as follows:

TABLE 7

| Drawing step | Stretching conditions 1. rolls speed m/s | 1. rolls temperature °C. | 2. rolls speed m/s | 2. rolls temperature °C. | 3. rolls speed m/s | 3. rolls temperature °C. | Stretching % | Titre dtex | Tenacity cN/dtex | Elongation % |
|---|---|---|---|---|---|---|---|---|---|---|
| 1. drawing | 0.39 | 90 | 5 | 90 | — | — | 1180 | 3.25 | 17.6 | 4.9 |
| 2. drawing | 0.39 | 90 | 5 | 90 | — | — | 1180 | 3.25 | 14.0 | 4 |

In the measurement of the elongation and tenacity, a drawing gap of 100 mm and a drawing speed of 10 mm/min was used, which gives values lowered by 3–4 cN/dtex compared to DIN 5381.

We claim:

1. A high strength polyethylene fibre, which is prepared by melt spinning polyethylene having a high density through a spinnerette, by cooling the fibres coming out from the spinnerette and by stretching the fibre obtained at a temperature of 50°–150° C., characterized in that the polyethylene used in the melt spinning is a homopolymer of ethylene, which fullfills the following conditions:

a weight average molecular weight $M_w$ is between 125000–175000 g/mol;

the number average molecular weight $M_n$ is between 26000–33000 g/mol;

a polydispersity ($M_w/M_n$) is below 5;

a density is greater than 955 g/dm$^3$;

and that the stretching degree in the drawing step is at least 400%.

2. A polyethylene fibre according to claim 1, characterized in that the stretching of the fibre is carried out in two or more steps.

3. A polyethylene fibre according to claim 1, characterized in that the drawing is carried out by using rolls having a surface temperature between 50°–150° C.

4. A polyethylene fibre according to claim 1, characterized in that the fibre is stretched in the drawing step 400–2500%.

5. A polyethylene fibre according to claim 1, characterized in that the polydispersity is between 2–5.

6. A polyethylene fiber according to claim 2, characterized in that the drawing is carried out by using rolls having a surface between 50°–150° C.

7. A polyethylene fiber according to claim 2, characterized in that the fiber is stretched in the drawing step 400–2500%.

8. A polyethylene fiber according to claim 3, characterized in that the fiber is stretched in the drawing step 400–2500%.

9. A polyethylene fiber according to claim 2, characterized in that the polydispersity is between 2–5.

10. A polyethylene fiber according to claim 3, characterized in that the polydispersity is between 2–5.

11. A polyethylene fiber according to claim 4, characterized in that the polydispersity is between 2–5.

12. A polyethylene fiber according to claim 1, characterized in that the polyethylene used possesses a density greater than 958 g/dm$^3$.

13. A polyethylene fiber according to claim 4, characterized that the fiber is stretched in the drawing step 700–2500%.

14. A polyethylene fiber according to claim 7, characterized that the fiber is stretched in the drawing step 700–2500%.

15. A polyethylene fiber according to claim 8, characterized that the fiber is stretched in the drawing step 400–2500%.

* * * * *